US006121763A

United States Patent [19]

Wilhelm et al.

[11] Patent Number: 6,121,763

[45] Date of Patent: Sep. 19, 2000

[54] CIRCUIT ARRANGEMENT FOR GENERATING A RESISTANCE BEHAVIOR WITH AN ADJUSTABLE POSITIVE TEMPERATURE COEFFICIENT AS WELL AS APPLICATION OF THIS CIRCUIT ARRANGEMENT

[75] Inventors: Wilhelm Wilhelm, Munich; Josef Hoelzle, Bad Woerischofen, both of German Dem. Rep.

[73] Assignee: Siemens Aktiengesellschaft, Munich, Germany

[21] Appl. No.: 08/866,415

[22] Filed: May 30, 1997

[30] Foreign Application Priority Data

May 30, 1996 [DE] Germany ..... 196 21 749

[51] Int. Cl.[7] ..... G05F 3/16

[52] U.S. Cl. ..... 323/315; 323/313; 323/907

[58] Field of Search ..... 323/312, 313, 323/315, 907; 330/256, 257, 288; 327/535, 538, 539

[56] References Cited

U.S. PATENT DOCUMENTS

| | | | |
|---|---|---|---|
| 3,956,661 | 5/1976 | Sakamoto et al. . | |
| 4,243,948 | 1/1981 | Schade, Jr. | 330/289 |
| 4,313,082 | 1/1982 | Neidorff . | |
| 4,490,669 | 12/1984 | Wilhelm | 323/313 |
| 4,492,914 | 1/1985 | Hitomi . | |
| 4,736,126 | 4/1988 | Susak | 323/907 |
| 4,882,533 | 11/1989 | Kelley . | |
| 4,956,567 | 9/1990 | Hunley et al. . | |
| 5,880,582 | 3/1999 | Sawada | 323/315 |

FOREIGN PATENT DOCUMENTS

| | | | |
|---|---|---|---|
| 0 492 117 A2 | 7/1992 | European Pat. Off. . | |
| 2032659 | 5/1980 | United Kingdom | 323/907 |

OTHER PUBLICATIONS

"Kennen Sie Stromspiegel?" *Funkschau* 26, Jun. 1983, pp. 44–47.

Tietze et al.: *Halbleiter–Schaltungstechnik*, Berlin, Springer Verlag, Mar. 1985, pp. 62–63.

*Primary Examiner*—Matthew Nguyen
*Attorney, Agent, or Firm*—Hill & Simpson

[57] ABSTRACT

A circuit arrangement generates a resistance behavior with an adjustable positive temperature coefficient. A second ohmic resistance element is connected in parallel with a series circuit of a first ohmic resistance element and a diode element wherein the value of the second ohmic resistance element is set corresponding to the desired temperature coefficient.

3 Claims, 1 Drawing Sheet

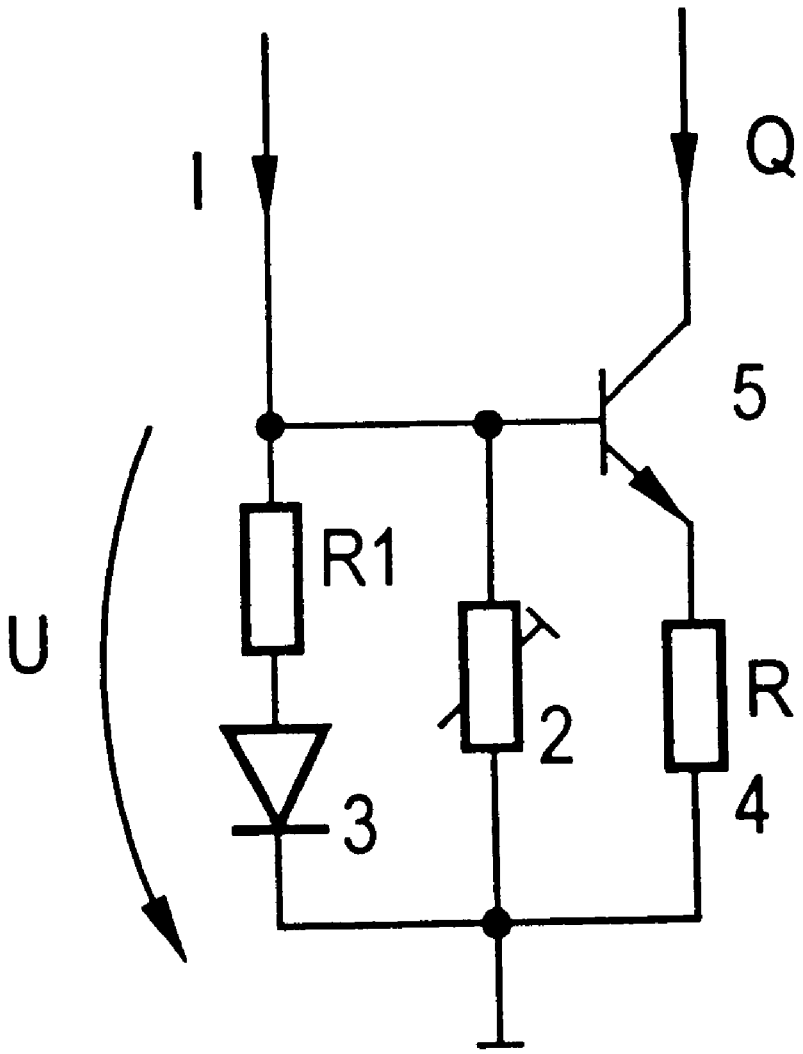
I
Q
5
R1
U
2
R
3
4

CIRCUIT ARRANGEMENT FOR GENERATING A RESISTANCE BEHAVIOR WITH AN ADJUSTABLE POSITIVE TEMPERATURE COEFFICIENT AS WELL AS APPLICATION OF THIS CIRCUIT ARRANGEMENT

BACKGROUND OF THE INVENTION

The present invention generally relates to a circuit arrangement for generating a resistance behavior with an adjustable positive temperature coefficient as well as the application of this circuit arrangement in a current mirror circuit.

A temperature compensation circuit with a fixed compensation behavior is known, for example, from Tietze/Schenk, *Halbletier-Schaltungstechnik*, Springer-Verlag, $7^{th}$ ed., Chapter 4.6.3. As provided in this teaching, a diode is connected in the input current path of a simple current mirror. The diode compensates the temperature effect in the transistor in the output current path. However, the compensation is fixed by the selection of the diode.

A large number of electrical and electronic components, such as, for example, light-emitting diodes, laser diodes, sensors, display elements, controllers, etc., provide during operation an undesired temperature dependency with a negative coefficient. In order to achieve a constant behavior over a large temperature region, corrective circuits with positive temperature coefficients are often provided in components of this sort. Since these temperature coefficients are supposed to assume different values according to the component to be compensated, different compensation circuits or compensation elements must be used, depending on the respective component. An adaptation to the temperature behavior of the respective component is, therefore, typically expensive to construct.

SUMMARY OF THE INVENTION

It is, therefore, an object of the present invention to provide a compensation means with adjustable positive temperature coefficients.

To this end, in an embodiment, the present invention provides a circuit arrangement for generating a resistance behavior with an adjustable positive temperature coefficient having a series circuit of a first ohmic resistance element and a diode element. The circuit arrangement has a second ohmic resistance element connected in parallel with the series circuit wherein the value of the second ohmic resistance element is adjustable corresponding to a desired temperature coefficient.

In another embodiment of the present invention, a current mirror circuit is provided. The circuit has an input current that feeds a circuit arrangement. The circuit arrangement further has a series circuit wherein the value of the second ohmic resistance element is adjustable corresponding to a desired temperature effect and further wherein a voltage drop is supplied to a base-emitter path of a transistor wherein an output current can be picked off at a collector of the transistor and further wherein an emitter resistance element at the emitter terminal of the transistor has the same value as the first ohmic resistance element of the circuit arrangement.

The circuit arrangement of the present invention preferably has a series circuit with a first ohmic resistance element and a diode element that is connected in parallel to a second ohmic resistance element wherein the value of the second ohmic resistance element is set corresponding to the desired temperature coefficient.

A preferred current mirror circuit has in its input current path a circuit arrangement consisting of a first and a second ohmic resistance element as well as a diode element. The circuit arrangement is thereby fed by a means of an input current, and the voltage dropped at the arrangement is supplied to the base-emitter path of a transistor. An emitter resistance element having the same value as the first ohmic resistance element of the circuit arrangement is inserted into the emitter line of the transistor. The output current of the current mirror circuit can be picked off at the collector of the transistor.

Additional features and advantages of the present invention are described in, and will be apparent from, the detailed description of the presently preferred embodiments and from the drawings.

BRIEF DESCRIPTION OF THE DRAWINGS

FIG. 1 illustrates a schematic diagram of an embodiment of a circuit arrangement of the present invention.

DETAILED DESCRIPTION OF THE PRESENTLY PREFERRED EMBODIMENTS

In the exemplary embodiment, as illustrated in FIG. 1, the circuit arrangement of the present invention consists of an ohmic resistance 1 and a diode 3 connected in series thereto in the let-through direction. The series circuit of the resistance 1 and the diode 3 is connected in parallel with an ohmic resistance 2. The resistance 2 can be adjusted. A current I fed into the circuit arrangement of the present invention generates a voltage U over the circuit arrangement. Overall, a resistance behavior of the entire circuit arrangement results wherein the resistance value, with a positive coefficient, is dependent on the temperature. The voltage U, dependent on the current I and the temperature, can, for example, serve for the further driving of a driver circuit that, in turn, supplies a component that is to be supplied, such as, for example, a light emitting diode.

In the present embodiment, the circuit arrangement of the present invention is used in a current mirror circuit in which the circuit arrangement forms the input circuit of the current mirror circuit with the resistances 1 and 2 as well as the diode 3, and in which a transistor 5 connected with an emitter resistance 4 represents the output circuit. The base of the transistor 5 is thereby connected with a node point of the first and second resistances 1 and 2, while the emitter of the transistor 5 is connected with the node point of the diode 3 and the resistance 2, with the intermediate connection of the emitter resistance 4. The conductivity type of the transistor 5 is selected corresponding to the poling of the diode 3. An output current Q can be picked off at its collector, which current in relation to the current I has a temperature coefficient that can be set by means of the resistor 2. Finally, the node point of the diode 3, the resistance 2 and the emitter resistance 4 can be connected to a reference potential to achieve defined potential relationships.

The resistance value of the first resistance 1 and the of emitter resistance 4 is thereby chosen equally large. The value of the resistance 2 can, for example, be chosen between infinity and four times the value of the resistor 1. For the value infinity, a temperature coefficient of 0.3%/K results, while for the value of four times the value of the resistor 1, a temperature coefficient of 1%/K results.

As a result, the circuit arrangement of the present invention advantageously includes a minimal component requirement, a simple adjustability of the temperature coefficient, high capacity for integration, and minimal aging, as well as large compensation ranges, voltage ranges and temperature ranges.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A current mirror circuit with an adjustable positive temperature coefficient, the current mirror circuit comprising:

a series circuit having a first ohmic resistor element connected in series to a diode element;

a second ohmic resistor element connected in parallel to the series circuit, said second ohmic resistor element being adjustable according to a desired temperature coefficient;

a transistor having a base connected to an input side of the series circuit and the second ohmic resistor element, an emitter connected to an emitter resistor element, and a collector for outputting an output current; and an input current for feeding the input side of the series circuit, the second ohmic resistor element, and the base of the transistor.

2. The current mirror circuit according to claim 1, wherein the emitter resistor element has a same resistance value as the first ohmic resistor element.

3. The current mirror circuit according to claim 1, further comprising a voltage generated across the series circuit for driving a driver circuit, said driver circuit for driving a light-emitting diode.

* * * * *